United States Patent [19]

Krekeler

[11] 4,391,472

[45] Jul. 5, 1983

[54] CORE ELIMINATOR FOR MINING, ROAD WORKING OR EARTH MOVING MACHINERY

[75] Inventor: Claude B. Krekeler, Cincinnati, Ohio

[73] Assignee: The Cincinnati Mine Machinery Company, Cincinnati, Ohio

[21] Appl. No.: 197,892

[22] Filed: Oct. 17, 1980

[51] Int. Cl.[3] ..... E21C 27/24; E21C 35/18

[52] U.S. Cl. ..... 299/86; 175/91; 299/89

[58] Field of Search ..... 299/80, 85, 86, 89; 175/91, 404

[56] References Cited

U.S. PATENT DOCUMENTS

| | | | |
|---|---|---|---|
| 809,350 | 1/1906 | Wissemann | 299/80 X |
| 1,005,544 | 10/1911 | Henderson | 299/76 X |
| 1,276,249 | 8/1918 | Morgan | 299/85 |
| 2,692,130 | 10/1954 | Ruth | 299/89 X |
| 3,279,856 | 10/1966 | Silks | 299/85 |
| 3,290,099 | 12/1966 | Lundquist | 299/85 |
| 3,459,453 | 8/1969 | Brill et al. | 299/80 X |

*Primary Examiner*—Ernest R. Purser

*Attorney, Agent, or Firm*—Frost & Jacobs

[57] ABSTRACT

A core eliminator for mining, road working or earth moving machinery in which a bit carrying mounting means is movably secured to a driven element. Means are associated with the driven element and the movable mounting means so as to guide said mounting means at one time into the path of what would otherwise be a core formation, and to guide such mounting means at another time to an out of the way position so that the mounting means may clear the machinery involved. Such means may include resilient, cam, pneumatic, hydraulic, electronic or electric arrangements.

In one form of the invention the mounting means is slidably mounted in ways provided in the driven element and urged by resilient means into contact with a cam which extends across a machine member located at one side of the driven element and to which the driven element is secured. In a modification of the invention the slidable mounting means rides on the cam instead of against it. In a further modification of the invention the cam extends along one side of the driven element and is provided with a low profile towards the material being worked and a high profile removed therefrom. The mounting means is pivotally attached to the driven element and provided with means which urges it to extend over the low profile and into the path of what would otherwise be a core formation, the same means urging the mounting means against the cam in the region of the high profile so as to pivot the mounting means to an out of the way position.

21 Claims, 10 Drawing Figures

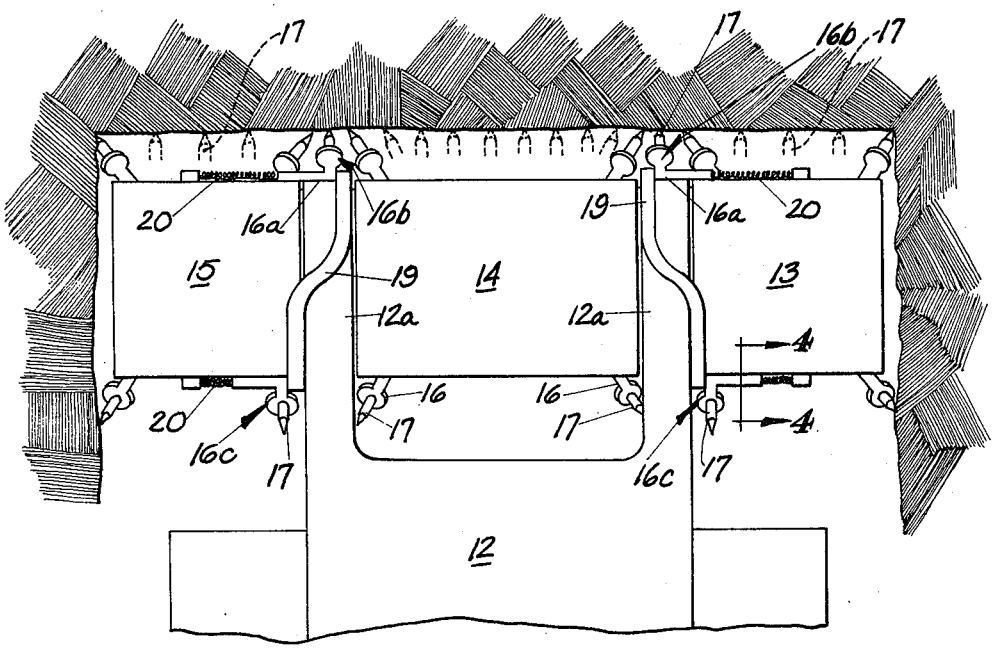
FIG 3
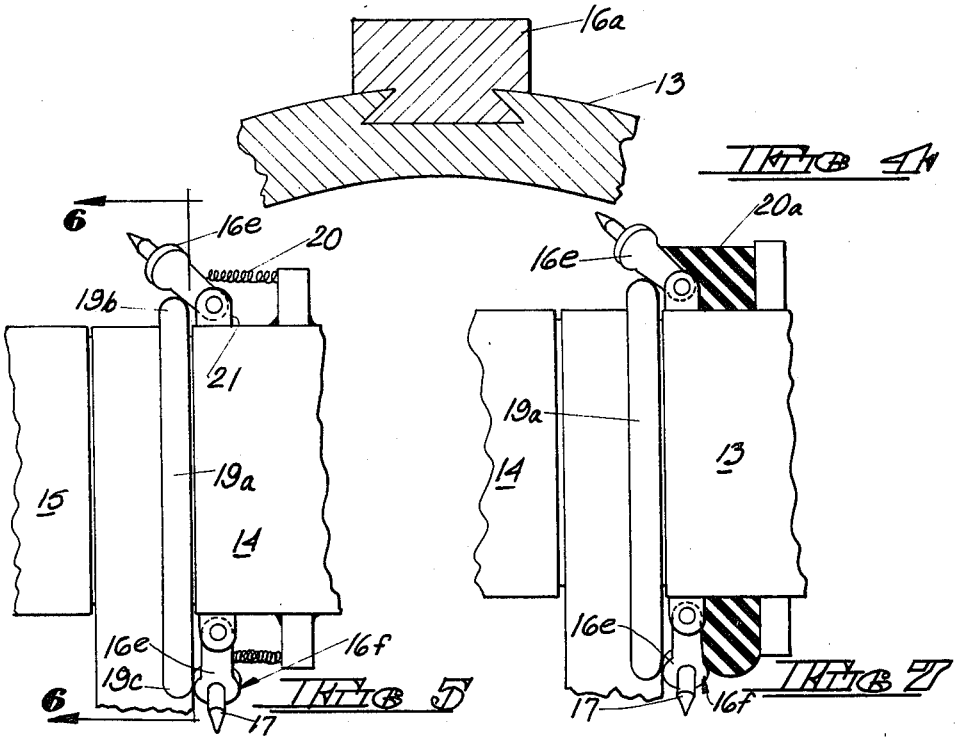
FIG 4
FIG 5
FIG 7

CORE ELIMINATOR FOR MINING, ROAD WORKING OR EARTH MOVING MACHINERY

TECHNICAL FIELD

This invention has particular use in the mining, road planing and earth moving fields. It relates to means for eliminating cores which often form when certain kinds of machinery are used in the mining of particular types of materials. The invention, while applicable in all of the fields mentioned, will be described primarily in conjunction with certain kinds of mining machines.

In typical mining or earth working machinery, cutting elements are replacably mounted in mounting means. Recently these mounting means have been themselves replacably located in base members which are affixed to some driven part of the machinery. Such driven part may take the form of a cutter chain, cutter wheel, cutter arm or rotating drum. As the machinery is advanced, the elements just mentioned will be driven. The mounting means, cutting elements and base members are all arranged on these driven parts so as to define a carefully determined pattern to provide for optimum removal of the material being worked upon.

In some equipment, no matter how carefully the various elements are arranged, cores will form because the material cannot for some reason or other be reached by a cutting element. An example of this is the continuous miner of the drum head variety. Typically such a miner may have a drum head supported on a boom arrangement. Such arrangement may include a pair of booms and three drums supported thereby. Gaps will occur between each of the end drums and the adjacent middle drum. These gaps result in formations which are not acted upon by the cutting elements; such formations are known as "cores". Core growth is greater in some types of material than in others; material such as relatively clean coal, for example, is fairly easily fractured and will display a minimum of core growth. On the other hand, the mining of material such as coal containing stratified impurities (including iron pyrites, sulfur, fire clay, etc.), which is fractured with difficulty, results in serious core growth. These cores hamper the operation of the machinery and are damaging to it.

The present invention is directed to means for eliminating these cores.

BACKGROUND ART

No preliminary patentability search of the United States patent art has been conducted in conjunction with this invention. It is known, however, that the prior art has attempted to solve the problem of core growth and core damage in various ways. U.S. Pat. No. 3,834,764 which issued Sept. 10, 1974 to Claude B. Krekeler for Core Breaking Means concentrated on protecting the mounting means and on providing auxiliary cutting elements to break the cores after said cores were permitted to grow. In other instances trim chains have been employed to bridge the gaps aforementioned. Another known prior art arrangement is to mount a drum with a universal mount so that it could be canted from time to time into the path of what would otherwise be a core formation.

Other prior art workers have taken still different approaches. One of these was to provide a considerable number of bit positions so that the paths of travel of the cutting elements would be as close together as possible whereby to minimize core growth; an example of such an arrangement is taught in U.S. Pat. No. 1,528,546. Other arrangements have included chains wherein some of the bits are arranged in primary cutting positions and others of the bits are located in secondary or lower cutting positions; examples of such chains are taught in U.S. Pat. Nos. 2,832,579 and 3,307,875.

The foregoing prior art approaches have helped the situation but they are not without disadvantages. The prior art has not really eliminated core growth. The machinery or techniques employed have proved to be quite expensive and difficult to maintain. Some of the arrangements, particularly those that call for the number of bit positions to be considerably increased, make the feeding of the driven element into the material being worked difficult and slow.

The present invention eliminates the formation of cores by an arrangement which is relatively simple to install, inexpensive and easily maintained in the field.

DISCLOSURE OF THE INVENTION

As the driven element, that element of the machinery on which the base members, mounting means and cutting elements are carried, of the machinery advances towards the material being worked, the arrangement of cutting elements has heretofore been such that not all of the material embraced by the machinery could be cut with the result that cores formed. The present invention provides means for shifting a cutting element along its driven element so as to place it in the path of what otherwise would have been a core formation, whereby to work the material and prevent that core from forming, and to then shift it out of the way so that such cutting element may clear the means on which it is arranged. A number of these shiftable cutting elements will be employed. Those driven elements which have a number of base members, mounting means and cutting elements displayed thereon, will be furnished with a number of these shiftable mounting means (each having a cutting element therein).

The means for shifting or reciprocating a mounting means (also commonly referred to in the art as a tool or bit holder or bit carrying lug, or simply as a holder or lug) back and forth into and out of the path of what would otherwise be a core may take various forms. Such means could, by way of example only, comprise a piston and cylinder arrangement, pneumatically, hydraulically or electrically actuated, or some other electronic or electrically actuated means such as, also by way of example only, a solenoid actuated piston. These arrangements could be provided with sensors or timing devices to insure that the movable mounting means (with a cutting element mounted therein) extended beyond the kerf formed by the fixed-position cutting elements at just the right time so as to knock off the core which begins to form between kerfs, thus eliminating such core. In the preferred arrangement, however, cam means are provided for mounting means which are slidably affixed, or pivoted, to the driven element.

Various cam arrangements may be provided in order to achieve the desired result. In some instances the cam will be so located on the machinery, between adjacent driven elements, that a resiliently biased mounting means will be urged against same to at one time place the cutting element carried by that mounting means in position to bite into that material which would otherwise have formed a core, whereafter the cam will cause such mounting means to retreat to a position enabling it to clear the machinery as rotation of the driven element continues. In a modification of this the mounting means may ride on the cam with or without the aid of any resilient means. In the arrangements so far described the cam will be arranged on the machinery so as to bridge the gap between, for example, adjacent drums.

In another arrangement the cam may be located on the machinery, between adjacent drums but quite close to one of them, and provided with an eccentric shape as compared to the driven element. In this arrangement a mounting means will be pivotally attached to a driven element and urged against the eccentric cam by resilient means. At the forward end of the driven element the cam will be "low" so that the mounting means and cutting element carried thereby will be forced thereover into the path of what would otherwise have been a core growth. As the driven element continues to rotate the mounting means will ride on the cam towards a "high" position wherein it will be forced out of its former cutting path and free of the machinery; other pivoted, biased mounting means and cutting elements will shift or rotate into position, depending on the arrangement utilized, to further insure that the core is eliminated.

The particular mounting means utilized to carry the cutting elements which eliminate the core are affixed to the driven part of the machinery utilized. In those instances wherein the mounting means is shiftable with respect to the driven element to which it is affixed, the mounting means will preferably have a dove-tailed, or tongue-and-groove, connection with such driven element. This will usually be the case whether the actuating means comprises a cam, a piston cylinder means, or some other arrangement. In still other arrangements the mounting means may be pivoted on the driven element for lateral movement so that it will extend to one side thereof into the path of what would otherwise have been a core growth. Again, this may be the case regardless of the particular means utilized to actuate such mounting means.

More specifically, but still by way of example only, in a continuous drum head miner which typically utilizes a forwardly extending boom on which three rotatable drums are mounted, there are boom extensions which separate the middle drum from the end ones and it is these extensions which result in the gaps which must be bridged in some manner if core growth is to be prevented. In this example such growth would be the pair of cores formed by the three kerfs established by the three drums, one such core to either side of the middle drum. In the present invention this is accomplished by providing mounting means on one or more of the drums in such manner that they may be so moved with respect to their particular drums that the cutting elements carried thereby will project across the boom extension at the forward end thereof so as to bridge the gap and contact the material which would otherwise not be worked, whereafter the mounting means are moved on their respective drums so as to clear the boom and related machinery as rotation of the drums continues.

BRIEF DESCRIPTION OF THE DRAWINGS

FIG. 3 is a view similar to that of FIG. 2 but modified to show one of the embodiments of the instant invention.

FIG. 4 is a fragmentary sectional view taken on the line 4—4 of FIG. 3.

FIG. 5 is a fragmentary view, generally similar to corresponding portions of the apparatus shown in FIGS. 2 and 3 but showing a further modification of the invention.

FIG. 7 is a view similar to that of FIG. 5 but showing yet another modification of the invention.

DETAILED DESCRIPTION OF THE INVENTION

Figure 1:
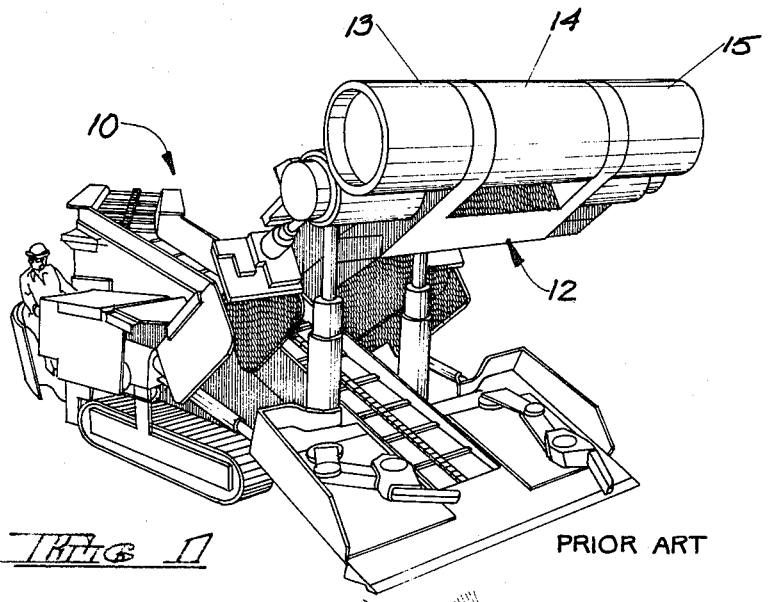
FIG 1 PRIOR ART
FIG. 1 is a perspective view, partly diagrammatic and partly schematic, of a prior art continuous drum head miner to which the present invention may be applied.
Figure 2:
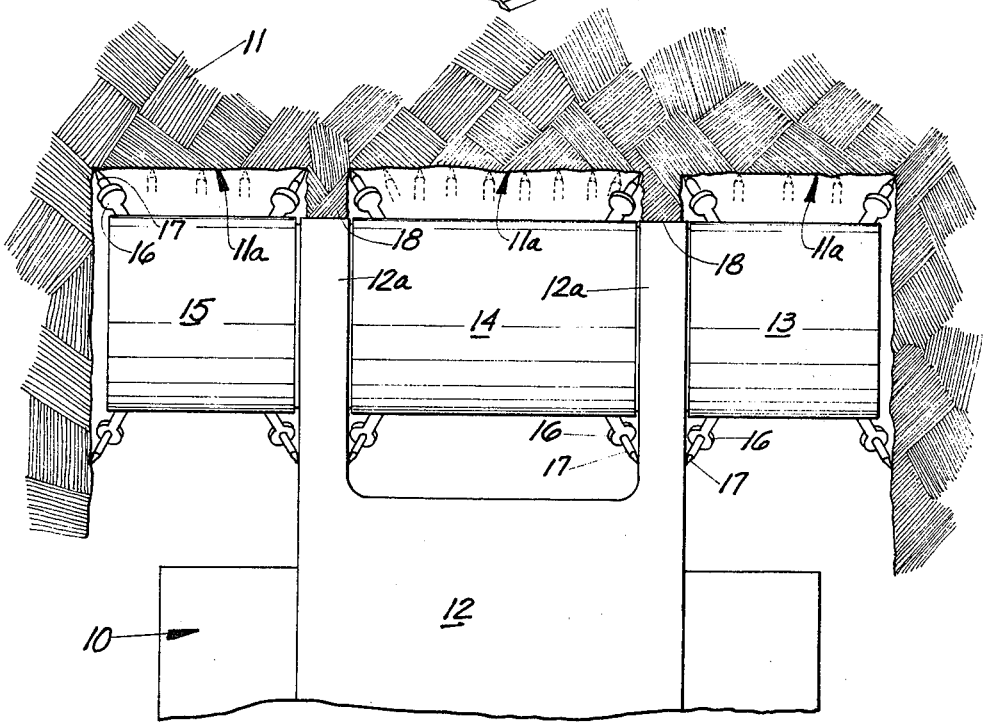
FIG. 2 is a fragmentary top view, partly diagrammatic and partly schematic, showing the boom and drum arrangement of the prior art continuous miner depicted in FIG. 1.

FIGS. 1 and 2 depict an exemplary prior art continuous drum head miner. An operator advances the continuous miner 10 towards a face of coal 11 to be mined. The continuous miner depicted in these Figures includes a boom structure 12 which supports three drums 13, 14 and 15 along with the various mechanisms (not shown in detail) required to rotate these drums. It will be understood by those skilled in the art, as generally depicted in FIG. 2, that there will be a plurality of mounting means 16, each having a cutting element 17 located therein, disposed in a desired pattern about the full periphery of each of the drums 13, 14 and 15. These mounting means 16 and cutting elements 17 will be located in patterns designed to achieve maximum efficiency as the continuous miner 10 is advanced into the face of coal 11 and as the drums 13, 14 and 15 are rotated. The boom structure 12 along with the rotating drums carried thereby may also be raised and lowered as the mining operation proceeds.

Again, while this invention will be described in connection with a continuous miner of the type generally depicted in FIGS. 1 and 2, it is to be understood that the principles thereof may be applied to other mining, road working or earth moving machinery. And while the apparatus is described in connection with the mining of coal it will be understood that these principles also apply to the mining of other materials including hard rock materials such as iron ore, potash, trona, gypsum, salt and other materials, as well as to the planing of road surfaces and the moving of earth such as in trenching and the like.

The rotating drums 13, 14 and 15 are mounted on boom struts 12*a*. The various mounting means-cutting element combinations 16, 17 are, as previously noted, so disposed on the drums as to achieve maximum efficiency in the mining of the coal face 11. The presence of the boom struts 12*a*, however, prohibits the mounting means-cutting element combinations from protruding inwardly of the mining machine structure. This results in the formation of "cores" 18 which impinge on the boom struts 12*a* and impede further forward progress of the continuous miner 10; the impingement of such cores on the boom struts may also result in damage to these struts and to the drums carried thereby. The gaps between adjacent drums as occasioned by the presence of the boom struts 12*a* are what result in the formation of the cores 18. The prior art has in some instances solved the problem of core formation with respect to a continuous miner of the type depicted in these FIGS. 1 and 2 by installing trim chains (not shown) on the machinery and positioned so as to fill in the gap just referred to. While this is a satisfactory arrangement, it is also an expensive one.

Turning now to FIGS. 3 and 4, one way in which the present invention solves the problem of core formation is illustrated. A cam rail 19 is affixed to the boom strut 12*a*. Special bit lugs or mounting means 16*a* are slidably positioned in various of the drums 13, 14 and 15. This may be achieved by means of a dove-tail or tongue and groove arrangement such as illustrated in FIG. 4. The special bit lugs or mounting means 16*a* are resiliently biased as indicated at 20 so that such mounting means is continuously urged against the cam rail 19.

In the prior art mining machines such as illustrated in FIGS. 1 and 2, the various prior art bit lugs or mounting means 16 with their respective cutting elements or bits 17 had to be so arranged on their respective drums 13, 14 and 15 that they would not interfere with the struts 12*a* and this is what resulted in the formation of cores 18 (the "growths" occuring between pairs of the kerfs 11*a*). In one embodiment of the present invention the shiftable lugs or mounting means 16*a* bridge the gap at the forward end of the machine by reason of the cam rail 19 and resilient means 20. The cam rail 19 and strut 12*a* are fixed with respect to the rotating drums 13, 14 and 15. As these drums continue their rotation the various shiftable lugs or mounting means 16*a* will retreat from a core cutting position such as indicated at 16*b* to an out of the way position such as indicated, for example, at 16*c*. This arrangement permits the special bit lugs 16*a* to bridge the gap at the forward end of the continuous miner as occasioned by the struts 12*a* whereby to eliminate the core which would otherwise be formed as illustrated in FIG. 2. As rotation of the drum proceeds, the shiftable lugs 16*a* will be guided by the cam rail 19 to positions wherein they clear the strut 12*a* as such lugs retreat from the face of the material being worked.

The resilient means 20 illustrated in FIG. 3 is depicted as a coil spring or the like. It will be understood that this means could be a block of solid resilient material such as indicated at 20*a* in FIG. 7 in connection with another embodiment of the invention. The precise nature of the resilient means is not a limitation on this invention. As indicated earlier herein the means to shift or reciprocate the various movable mounting means-cutting element (bit holder-bit) combinations may take still other forms such as pneumatic, hydraulic, electronic or electric means. Such means could, for example, be a pneumatic or hydraulic piston-cylinder arrangement, or a solenoid device, either with or without the aid of cams, such as are generally schematically indicated in FIGS. 8 and 9 respectively.

It is important only that there be a sufficient number of shiftable lugs 16*a* to provide enough cutting elements 17 to work on the material immediately forwardly of each of the struts 12*a* so as to eliminate the core which would otherwise be formed. Such lugs must be securely located, in a movable manner, in their respective drums. When cams such as the cam rail 19 are used, they must be so disposed as to permit these special lugs to provide cutting of the material in front of the struts 12*a* and to retract these lugs as drum rotation continues so that the bits or other cutting elements carried by the special lugs 16*a* will not hang up on the mining machine itself.

Figure 3A:
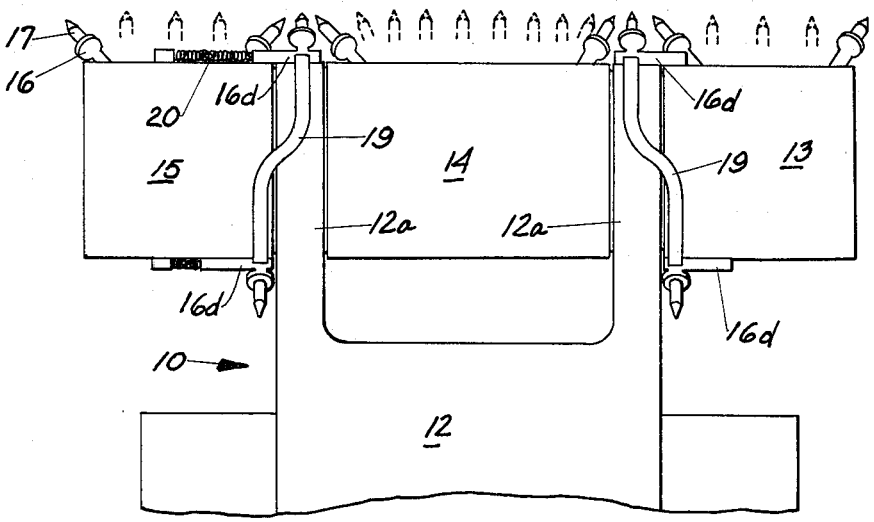
FIG. 3A is a view similar to that of FIG. 3 but showing another modification of the invention.

A variation of the invention is illustrated at the left side of FIG. 3A. In this arrangement the special lugs 16*d*, instead of being urged against a cam rail 19, are arranged so as to ride on such rail. In this particular modification resilient means 20 are employed to insure that the special lugs 16*d* will properly follow the cam rail 19. As indicated at the right side of FIG. 3A, however, it is possible to eliminate such resilient means 20 and to depend on the sliding engagement of the lug 16*d* with its respective drum and cam rail to effect the in and out movement of the lug with respect to the strut involved.

Figure 6:
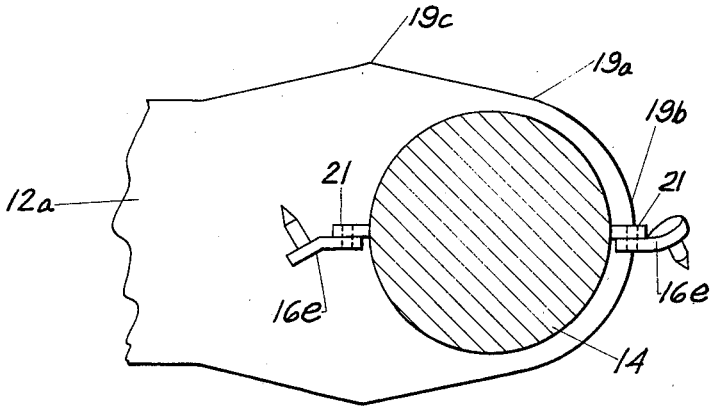
FIG. 6 is a view generally taken along the line 6—6 of FIG. 5.

Further modifications of the invention are illustrated in FIGS. 5, 6 and 7. In these Figures the modified cam rail 19*a* does not cross over the strut 12*a* as in the case of the arrangements of FIGS. 3 and 3A and it is eccentric with respect to the adjacent drums. Thus the modified cam rail 19*a* has a "low" projection at the forward end of the continuous miner and a "high" projection at the trailing side of the rotating drum structure; these positions are indicated at 19*b* and 19*c* respectively. A plurality of special lugs or mounting means 16*e* are pivotally arranged on various of the drums 13, 14 and 15 as indicated at 21. As the drums rotate so as to bring the various mounting means-cutting elements into engagement with the material being worked, resilient means 20 will rock the special lugs 16*e* to a position wherein they extend over the cam rail portion 19*b* and into the path of what would otherwise be a core formation. As the drums continue to rotate and bring the mounting means away from the material being worked such special mounting means will ride against the rail 19*a* and be rocked by the urging of the resilient means 20 until such mounting means reaches the out of the way position 16*f* indicated at the lower portions of FIGS. 5 and 7. The resilient means may take the form of a spring such as indicated at 20 in FIG. 5 or it may be a solid block of resilient material such as indicated at 20*a* in FIG. 7; other means may be employed, resilient or otherwise.

Figure 8:
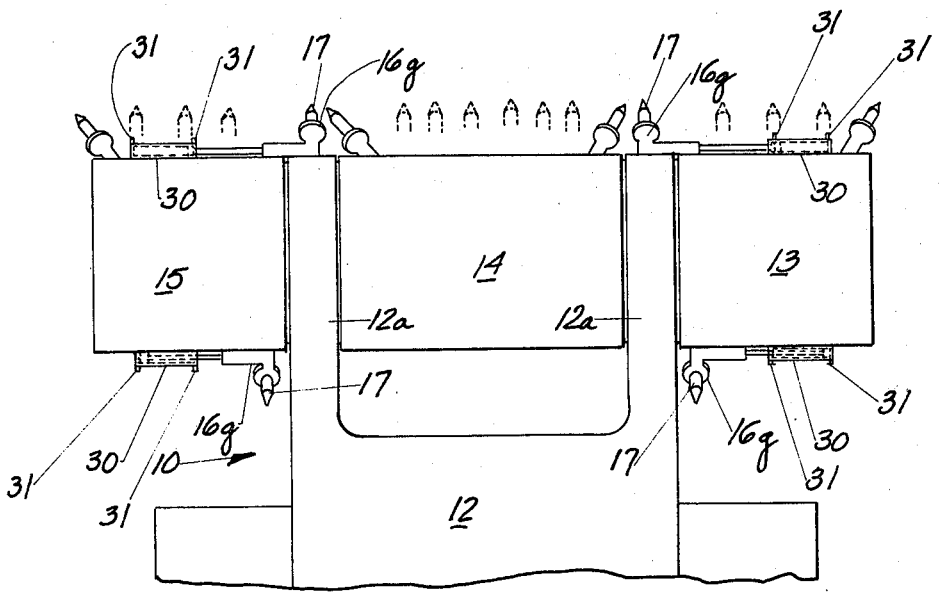
FIG. 8 is a fragmentary view, partly diagrammatic and partly schematic, in the manner of FIGS. 2 and 3, illustrating the fact that various pneumatic, hydraulic, electronic or electric means may also be employed to effect reciprocation of the mounting means-cutting element combinations in accordance with the teachings of this invention.
Figure 9:
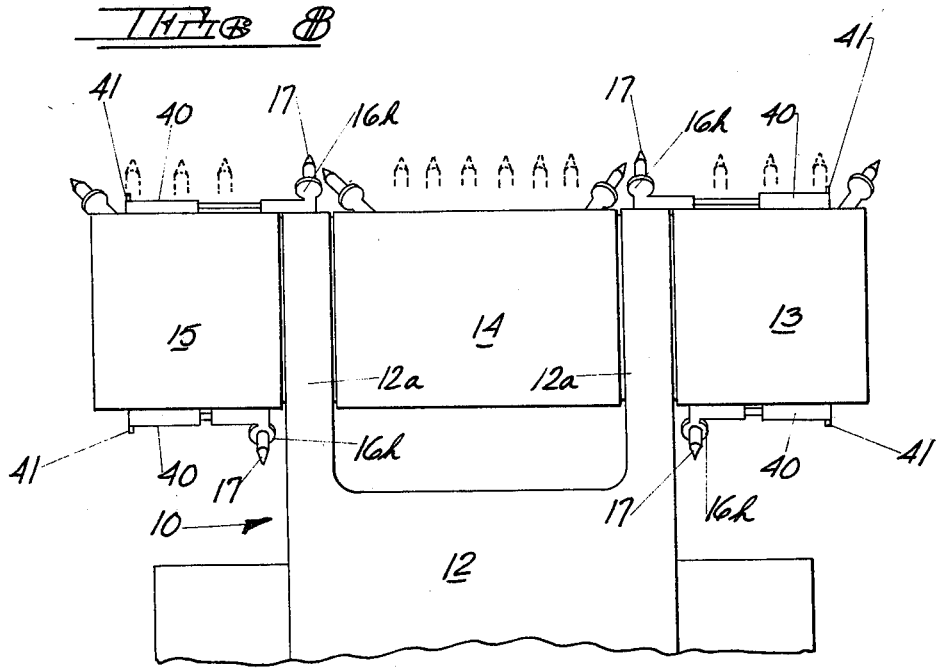
FIG. 9 is a view similar to FIG. 8 but emphasizing the use of electronic or electrical means to effect the desired reciprocation.

Other modifications of the invention are generally depicted in FIGS. 8 and 9. FIG. 8 illustrates the fact that a special shiftable bit holder 16*g* (mounting means or lug) may be actuated by pneumatic, hydraulic, electronic or electric means such as the pneumatic or hydraulic piston-cylinder arrangement 30 rather schematically there indicated, the fluid supply being diagrammatically illustrated at 31. A suitable timing, cam or sensor device (not specifically shown) could be associated with all of this to insure proper reciprocation of the special bit holder 16*g* in front of the boom strut 12*a*.

FIG. 9 illustrates and further emphasizes the fact that a special shiftable lug 16*h* may be actuated by electronic or electrical means such as the solenoid-piston arrangement 40 rather schematically there indicated, the electric supply being diagrammatically indicated at 41. Again, suitable timing cam or sensing means (not specifically shown) may be associated with all of this to insure proper reciprocation of the special lug 16*h* in front of the boom strut 12*a*.

It will be understood by those skilled in the art that the various arrangements generally depicted in FIGS. 8 and 9 could also be utilized to actuate pivoted, rather than sliding, lugs such as are shown in FIGS. 5, 6 and 7 at 16*e*.

In the practice of this invention it should be understood that there will be a great number of conventional bit lugs or mounting means and cutting elements 16, 17 arranged in a suitable pattern on the various drums 13, 14 and 15. Interspersed among these will be a relatively few of the special lugs 16*a*, 16*d*, 16*e*, 16*g* or 16*h* as desired. These special lugs are, of course, those which either slide back and forth forwardly of the struts 12*a*, or which pivot into and out of cutting position forwardly of such struts, as occasioned by the use of the respective arrangements shown in the Figures described herein.

The type of cutting element or bit mounted in the respective mounting means or lugs does not constitute a limitation on the present invention. The bits may be rotatable or non-rotatable within such lugs. The exact nature of the mounting means or lug is not a limitation on the invention except that it must be either slidable, shiftable or pivotal as described. Means are provided to insure that such lugs will present their respective cutting elements forwardly of the struts 12*a* at the face of the material being worked while bringing these lugs and bits to an out of the way position as the drum continues to rotate. There will be a sufficient number of the special lugs to insure that the core is eliminated as described.

As mentioned earlier herein, the present invention does away with the necessity of providing trim chains, universal mounts for the canting of certain drums, and other expensive mechanisms previously attempted as means for eliminating cores. Some prior art efforts were directed to making the strut elements 12*a* quite narrow in the hope that this would result in cores which would in effect destroy themselves by breaking off because of the inherent weakness of such narrow cores; this, however, has also proved unsatisfactory.

Thus, by way of brief summary, the present invention, in one form, utilizes special lugs slidably mounted in ways provided in certain of the drums along with cam means to guide such lugs into and out of position forwardly of the boom struts 12*a* so as to eliminate the cores which would otherwise form in those areas. In another form of the invention this is accomplished by rocking the pivotally mounted special lugs into and out of the positions required, again as guided by a cam member. In some instances the special lugs are urged against the cam while in other instances they ride thereon. Various resilient means may be employed as required. Other forms and embodiments of the invention include shiftable lugs which may be pneumatically, hydraulically, or electronically (including electrically) actuated.

Various forms of the present invention have been shown and described. It will be understood by those skilled in the art that further modifications may be made in this invention without departing from the scope and spirit thereof. It will also be understood by those skilled in the art that while the invention has been shown and described with respect to particular structures and arrangements, the invention is not to be limited to those particular structures and arrangements except insofar as they are specifically set forth in the sub-joined claims.

Having thus described the invention, what is claimed as new and what is desired to be protected by Letters Patent is:

1. A core eliminator for mining, road working or earth moving machinery comprising at least a pair of rotatable, driven drums having a plurality of cutter bits disposed thereon, said drums being rotatably mounted on a boom strut located between said drums and between the kerfs formed by said drums and cutter bits as the machinery operates on the material being worked by it; at least one bit holder attached to one of said drums and having a bit therein normally within the confines of the kerf formed by that drum, said bit holder being movable on that drum to an extended position so as to bring said bit therein beyond the kerf formed by that drum and towards the kerf formed by the other drum whereby to destroy the core which would otherwise form between said kerfs; and additional means to move said bit holder and bit therein to said extended position between said kerfs and to retract said bit holder and bit therein from said extended position, said additional means comprising a cam.

2. The core eliminator of claim 1 in which said drum is provided with a way; said bit holder being slidable in said way.

3. The core eliminator of claim 2 in which said way and said bit holder comprise a dove-tailed tongue-and-groove arrangement.

4. The core eliminator of claim 3 including resilient means to urge said bit holder to slide in said way against said cam.

5. The core eliminator of claim 1 including resilient means to urge said bit holder against said cam.

6. The core eliminator of claim 1 in which said bit holder rides on said cam.

7. The core eliminator of claim 6 including resilient means to urge said bit holder to ride on said cam.

8. The core eliminator of claim 1 in which said cam extends across a portion at least of said boom strut.

9. The core eliminator of claim 8 including resilient means urging said bit holder against said cam.

10. The core eliminator of claim 8 in which said bit holder rides on said cam.

11. The core eliminator of claim 10 including resilient means urging said bit holder to ride on said cam.

12. A core eliminator for mining, road working or earth moving machinery comprising at least a pair of rotatable, driven drums having a plurality of cutter bits disposed thereon, said drums being rotatably mounted on a boom strut located between said drums and between the kerfs formed by said drums and cutter bits as the machinery operates on the material being worked by it; at least one bit holder attached to one of said drums and having a bit therein normally within the confines of the kerf formed by that drum, said bit holder being movable on that drum to an extended position so as to bring said bit therein beyond the kerf formed by that drum and towards the kerf formed by the other drum whereby to destroy the core which would otherwise form between said kerf; and additional means to move said bit holder and bit therein to said extended position between said kerfs and to retract said bit holder and bit therein from said extended position, said bit holder and bit therein moving on said drum to and from said extended position in a path parallel to the axis of said drum.

13. The core eliminator of claim 12 in which said additional means includes a resilient means.

14. The core eliminator of claim 12 in which said additional means comprises pneumatic means.

15. The core eliminator of claim 12 in which said additional means comprises hydraulic means.

16. The core eliminator of claim 12 in which said additional means comprises electronic means.

17. The core eliminator of claim 12 in which said additional means comprises electric means.

18. The core eliminator of claim 12 in which said additional means includes a member attached to said bit holder and means to reciprocate said member.

19. A core eliminator for mining, road working or earth moving machinery comprising at least a pair of rotatable, driven drums having a plurality of cutter bits disposed thereon, said drums being rotatably mounted on a boom strut located between said drums and between the kerfs formed by said drums and cutter bits as the machinery operates on the material being worked by it; at least one bit holder attached to one of said drums and having a bit therein normally within the confines of the kerf formed by that drum, said bit holder being movable on that drum to an extended position so as to bring said bit therein beyond the kerf formed by that drum and towards the kerf formed by the other drum whereby to destroy the core which would otherwise form between said kerfs; and additional means to move said bit holder and bit therein to said extended position between said kerfs and to retract said bit holder and bit therein from said extended position, said additional means including a continuous cam, said bit holder being pivotally attached to said drum, and further means constantly urging said bit holder against said cam.

20. The core eliminator of claim 19 in which said further means comprises a resilient means.

21. The core eliminator of claim 20 in which said cam extends along one side of said boom strut, said cam having a low profile towards the material being worked and a high profile away from such material, said resilient means urging said bit holder to pivot over said low profile and against said high profile.

* * * * *